US005776666A

United States Patent [19]

Texter et al.

[11] Patent Number: 5,776,666

[45] Date of Patent: Jul. 7, 1998

[54] TRIAZOLIUM THIOLATE BATHS FOR SILVER HALIDE DEVELOPMENT ACCELERATION

[75] Inventors: John Texter; Arthur Herman Herz; Henry Wolf Altland, all of Rochester, N.Y.

[73] Assignee: Eastman Kodak Company, Rochester, N.Y.

[21] Appl. No.: 25,474

[22] Filed: Mar. 3, 1993

Related U.S. Application Data

[63] Continuation-in-part of Ser. No. 763,029, Sep. 20, 1991, abandoned.

[51] Int. Cl.[6] ..... G03C 5/00; G03C 1/295

[52] U.S. Cl. ..... 430/445; 430/422; 430/423; 430/428; 430/429; 430/430; 430/460; 430/461

[58] Field of Search ..... 430/445, 430, 430/460, 461, 422, 423, 424, 428, 429

[56] References Cited

U.S. PATENT DOCUMENTS

| | | |
|---|---|---|
| 3,647,459 | 3/1972 | Taber et al. . |
| 3,901,709 | 8/1975 | Ebato et al. . |
| 4,137,079 | 1/1979 | Houle . |
| 4,351,896 | 9/1982 | Altland et al. . |
| 4,378,424 | 3/1983 | Altland et al. . |
| 4,404,390 | 9/1983 | Altland et al. . |
| 4,582,775 | 4/1986 | Toriuchi et al. . |
| 4,631,253 | 12/1986 | Mifune et al. . |
| 4,675,276 | 6/1987 | Nakamura et al. . |
| 4,939,075 | 7/1990 | Bergthaller et al. . |
| 5,037,726 | 8/1991 | Kojima et al. . |

FOREIGN PATENT DOCUMENTS

| | | |
|---|---|---|
| 0 054 414 B1 | 4/1985 | European Pat. Off. . |
| 0 321 839 A2 | 10/1989 | European Pat. Off. . |
| A-0 431 568 | 2/1991 | European Pat. Off. . |
| 2032923 | 6/1980 | United Kingdom . |

OTHER PUBLICATIONS

Patent Abstract of Japan, vol. 12, No. 12, Apr. 1988 (JP 62/253161).

*Primary Examiner*—Thorl Chea
*Attorney, Agent, or Firm*—Paul A. Leipold

[57] ABSTRACT

A method of accelerating black and white development comprising contacting a negative-type silver halide photographic element during processing with a developer prebath or a developer bath comprising an accelerator compound of the formula:

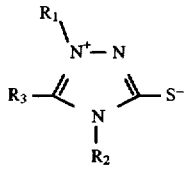

is disclosed, wherein $R_1$, $R_2$, and $R_3$ are substituents; said $R_1$, $R_2$, and $R_3$ may further combine with each other to form a 5-, 6-, or 7-membered ring; and wherein said developer prebath and developer bath do not contain any iron(III) ion complex salt having bleaching activity.

A bath selected from the group consisting of developer prebaths and developer baths for black and white development of a negative-type silver halide photographic element comprising an aqueous solution of accelerator compound of the formula:

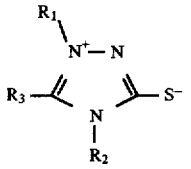

is also disclosed, wherein $R_1$, $R_2$, and $R_3$ are substituents; said $R_1$, $R_2$, and $R_3$ may further combine with each other to form a 5-, 6-, or 7-membered ring; with the proviso that said developer prebath and developer bath do not contain any iron(III) ion complex salt having bleaching activity or any nucleating agent capable of chemically fogging a negative-type silver halide emulsion; and said accelerator compound is present in an amount between $10^{-8}$ and $10^{-1}$ moles/L.

19 Claims, No Drawings

TRIAZOLIUM THIOLATE BATHS FOR SILVER HALIDE DEVELOPMENT ACCELERATION

RELATED APPLICATIONS

This application is a Continuation-in-Part of U.S. application Ser. No. 07/763,029 of Texter et al., filed Sep. 20, 1991, and entitled Triazolium Thiolate Baths for Silver Halide Development Acceleration now abandoned. This application is related to copending and commonly assigned U.S. application Ser. No. 07/763,028 of Texter et al., filed Sep. 20, 1991, and entitled Silver Halide Emulsion Development Accelerators.

FIELD OF THE INVENTION

This invention relates to the development of silver halide photographic material. It more particularly relates to the use of accelerators in development baths or prebaths.

BACKGROUND OF THE INVENTION

U.S. Pat. No. 3,901,709 (1975) by S. Ebato et al. relates to a combination of a poly(alkylene oxide) and a 1,2,4-triazoline-5-thione in lithographic materials.

U.S. Pat. No. 3,647,459 (1972) by R. C. Taber and W. H. Russell describes a radiographic material designed for rapid access roller transport processing. Acrylic interpolymers in combination with a development modifier such as indazole, mercaptotetrazole, 3-mercapto-1,2,4-triazole and sodium anthraquinone sulfonate are described.

U.S. Pat. No. 4,137,079 (1979) by C. G. Houle describes the use of 5-mercapto-1,2,4-triazole derivatives as antifoggants for silver plus dye image photothermographic materials.

U.K. Patent Application GB 2,032,923A discloses that 3-amino-5-mercapto-1,2,4-triazoles are useful antifoggants for incorporated coupler color materials.

U.S. Pat. Nos. 4,351,896 (1982) and 4,404,390 (1983) of H. W. Altland and D. D. F. Shiao relate to the use of certain S-blocked 1,4,5-trisubstituted 1,2,4-triazolium-3-thiolates as silver stabilizer precursors in photothermographic materials.

U.S. Pat. No. 4,378,424 (1983) of H. W. Altland, E. L. Dedio, and G. J. McSweeney relates to the use of triazolium thiolates to form water soluble light-insensitive silver complexes.

U.S. Pat. No. 4,631,253 by Mifune et al. (1986) discloses the use of triazolium thiolates during the precipitation of silver halide grains and the use of triazolium thiolates as ripeners during the precipitation of silver halide grains. This patent (column 9, line 26) specifically describes how soluble salts may be removed from the ripened emulsions. In the first claim (column 16, line 18), the presence of triazolium thiolates in combination with silver halide emulsion grains is mentioned only in the context of "during precipitation of said . . . grains or thereafter until during physical ripening of said grains . . .".

U.S. Pat. No. 4,582,775 by Toriuchi et al. (1986) discloses the coating of triazolium thiolates in silver halide layers, but in photographic elements designed for color diffusion transfer, processed under strongly alkaline conditions (28% aqueous KOH solution).

U.S. Pat. No. 4,939,075 (1990) and European Patent Application 0 321 839 A2 by Bergthaller et al. disclose the use of triazolium thiolates in bleaching baths and the use of triazolium thiolates as bleach accelerators when incorporated in bleaching baths. Since bleaching baths are used significantly after the photographic elements are coated and after a prebath (relative to development) and after the development process, our invention is not disclosed in these documents. These disclosures of Bergthaller et al. contain no teaching or suggestion that any compound, including triazolium thiolates, may be used in a bath as a development accelerator. Further, Bergthaller et al. provide no teaching or suggestion that any compound, including triazolium thiolates, may be used in a developer bath or in a developer prebath for any reason whatsoever, including black-and-white development acceleration of negative type materials.

European Patent Specification 0 054 414 B1 of Altland et al. (1982) discloses the use of triazolium thiolate silver halide stabilizer precursor compounds in a heat developable and heat stabilizable photographic silver halide material.

U.S. Pat. No. 4,675,276 by Nakamura et al. (1987) discloses the utilization of 1,2,4-triazolium-3-thiolate compounds that give stable and excellent quality photographic images without being accompanied by increased formation of fog and increased changes of sensitivity and gradation upon high temperature processing.

U.S. Pat. No. 5,037,726 by Kojima et al. (1991) discloses a method for forming a direct positive image from a material comprising a nucleation accelerator. Triazolium thiolate compounds are mentioned therein as nucleation accelerators. Kojima et al. provide no teaching or suggestion whatsoever that triazolium thiolates may be used for any purpose in any material other than in direct positive photographic materials or that any benefit could obtain from the use of triazolium thiolates in materials other than direct positive photographic materials. Specifically, Kojima et al. are silent about negative-type black-and-white photographic materials, and Kojima et al. provide no teaching or suggestion that triazolium thiolates could be used in such materials or could be used to any advantage in such materials. Additionally, Kojima et al. provide no teaching or suggestion that triazolium thiolates could be used or could be used to advantage as development accelerators in the black-and-white development of negative-type photographic materials. Kojima et al. teach that they prefer to incorporate their nucleation accelerators in the direct-positive photographic element when said element is formed, and no example, teaching, or suggestion is given that advantage accrues by incorporating said nucleation accelerators in developing solutions or prebaths thereof.

There is a continuing need for increasing processing speeds and for compounds that will result in increased acceleration of processing.

PROBLEM TO BE SOLVED BY THE INVENTION

It is known that the incorporation of development accelerating compound in photographic elements at the time of forming said elements can lead to severe fog formation upon processing said elements after storage.

The amount of development acceleration obtained in a development process with the incorporation of a given amount of development accelerating compound is sometimes more than or less than the amount desired by the user, and said amount of acceleration obtained cannot be conveniently modified by any known means other than by varying the amount of compound incorporated.

There remains a need for a method of providing accelerated development that does not require the addition of materials into the film during film manufacture. A technique that did not require such addition of materials in the films would eliminate the difficulties in storage or handling that may be incurred by the addition of such materials. Further, in some cases, accelerated development may not be desirable, and there is a need for a way to better control accelerated development.

SUMMARY OF THE INVENTION

An object of the invention is to overcome disadvantages of prior processes.

Another object of the invention is to provide accelerated development without the need to place additional materials into the photographic element.

These and other objects of the invention are generally accomplished by a method of accelerating black and white development comprising contacting a negative-type silver halide photographic element during processing with a developer prebath or a developer bath comprising an accelerator compound of the formula:

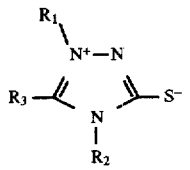

wherein $R_1$ is a substituted or unsubstituted alkyl group having from 1 to 28 carbon atoms, a substituted or unsubstituted alkenyl group having from 1 to 28 carbon atoms, a substituted or unsubstituted cycloalkyl group having from 3 to 28 carbon atoms, a substituted or unsubstituted aryl group having from 6 to 33 carbon atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkenyl, alkoxyalkyl, aryl, or phenoxy group connecting to a substituted or unsubstituted heterocyclic ring containing two or more heteroatoms having 1 to 25 carbon atoms;

$R_2$ is a substituted or unsubstituted amine group having from 0 to 25 carbon atoms, a substituted or unsubstituted alkyl group having from 1 to 28 carbon atoms, a substituted or unsubstituted alkenyl group having from 1 to 28 carbon atoms, a substituted or unsubstituted cycloalkyl group from 3 to 28 carbon atoms, a substituted or unsubstituted acyloxy group having from 2 to 25 carbon atoms, a substituted or unsubstituted alkoxy group having from 1 to 28 carbon atoms, a substituted or unsubstituted aryl group having from 6 to 33 carbon atoms, a substituted or unsubstituted heterocyclic ring having from 1 to 28 carbon atoms and one or more hetero atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkenyl, alkoxyalkyl, aryl, or phenoxy group connecting to a substituted or unsubstituted heterocyclic ring containing two or more hetero atoms having 1 to 25 carbon atoms;

$R_3$ is a substituted or unsubstituted amine group having from 0 to 25 carbon atoms, a substituted or unsubstituted alkyl group having from 1 to 28 carbon atoms, a substituted or unsubstituted alkenyl group having from 1 to 28 carbon atoms, a substituted or unsubstituted cycloalkyl group having from 3 to 28 carbon atoms, a substituted or unsubstituted acyloxy group having from 2 to 25 carbon atoms, a substituted or unsubstituted alkoxy group having from 1 to 28 carbon atoms, a substituted or unsubstituted aryl group having from 6 to 33 carbon atoms, a substituted or unsubstituted heterocyclic ring having from 1 to 28 carbon atoms and one or more hetero atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkoxyalkyl, aryl, or phenoxy group connecting to a substituted or unsubstituted heterocyclic ring containing two or more hetero atoms;

said $R_1$, $R_2$, and $R_3$ may further combine with each other to form a 5-, 6-, or 7-membered ring; and wherein said developer prebath and developer bath do not contain any iron(III) ion complex salt having bleaching activity.

A preferred embodiment of the invention comprises a bath selected from the group consisting of developer prebaths and developer baths for black and white development of a negative-type silver halide photographic element comprising an aqueous solution of accelerator compound of the formula:

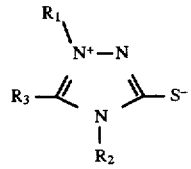

wherein $R_1$ is a substituted or unsubstituted alkyl group having from 1 to 28 carbon atoms, a substituted or unsubstituted alkenyl group having from 1 to 28 carbon atoms, a substituted or unsubstituted cycloalkyl group having from 3 to 28 carbon atoms, a substituted or unsubstituted aryl group having from 6 to 33 carbon atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkenyl, alkoxyalkyl, aryl, or phenoxy group connecting to a substituted or unsubstituted heterocyclic ring containing two or more heteroatoms having 1 to 25 carbon atoms;

$R_2$ is a substituted or unsubstituted amine group having from 0 to 25 carbon atoms, a substituted or unsubstituted alkyl group having from 1 to 28 carbon atoms, a substituted or unsubstituted alkenyl group having from 1 to 28 carbon atoms, a substituted or unsubstituted cycloalkyl group from 3 to 28 carbon atoms, a substituted or unsubstituted acyloxy group having from 2 to 25 carbon atoms, a substituted or unsubstituted alkoxy group having from 1 to 28 carbon atoms, a substituted or unsubstituted aryl group having from 6 to 33 carbon atoms, a substituted or unsubstituted heterocyclic ring having from 1 to 28 carbon atoms and one or more hetero atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkenyl, alkoxyalkyl, aryl, or phenoxy group connecting to a substituted or unsubstituted heterocyclic ring containing two or more hetero atoms having 1 to 25 carbon atoms;

$R_3$ is a substituted or unsubstituted amine group having from 0 to 25 carbon atoms, a substituted or unsubstituted alkyl group having from 1 to 28 carbon atoms, a substituted or unsubstituted alkenyl group having from 1 to 28 carbon atoms, a substituted or unsubstituted cycloalkyl group having from 3 to 28 carbon atoms, a substituted or unsubstituted acyloxy group having from 2 to 25 carbon atoms, a substituted or unsubstituted alkoxy group having from 1 to 28 carbon atoms, a substituted or unsubstituted aryl group having from 6 to 33 carbon atoms, a substituted or unsubstituted heterocyclic ring having from 1 to 28 carbon atoms and one or more hetero atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkoxyalkyl, aryl, or phenoxy group connecting to a substituted or unsubstituted heterocyclic ring containing two or more hetero atoms;

said $R_1$, $R_2$, and $R_3$ may further combine with each other to form a 5-, 6-, or 7-membered ring; with the proviso that said accelerator compound is present in an amount between $10^{-8}$ and $10^{-1}$ moles/L; and said developer prebath and developer bath do not contain any iron(III) ion complex salt having bleaching activity or any nucleating agent capable of chemically fogging a negative-type silver halide emulsion.

ADVANTAGEOUS EFFECT OF THE INVENTION

The invention has numerous advantages over prior processes. The invention allows the processing of negative-type black and white photographic materials in an accelerated manner without the necessity for adding additional materials to the photographic element. The incorporation of accelerating compounds of the present invention in developer baths and in developer prebaths permits the effective use of compounds that would otherwise cause severe fog and unacceptably high Dmin if coated in photographic elements when said elements were formed.

The optional use of our invention provides the customer with greater latitude in the use and processing of negative-type black-and-white photographic elements, and allows the user to conveniently control the amount of development acceleration obtained in a given processing time by giving the customer the latitude of controlling the amount of accelerating compound added to a processing developer bath or developer prebath. The acceleration is controllable as various amounts of the accelerator may be added to the bath to control the amount of acceleration. Additionally, the invention allows the use of the accelerator in a prebath such that the developer bath does not need to be changed, and additionally acceleration may be regulated as to amount without interfering with the time of development.

DETAILED DESCRIPTION OF THE INVENTION

Developer baths and developer prebaths containing triazolium thiolates to provide development acceleration in the development of negative-type black-and-white photographic materials are described in the present invention. Further, methods of accelerating black-and-white development of said materials are described. Suitable triazolium thiolates for use as said development accelerators are illustrated below in Formula I.

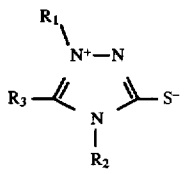

(I)

wherein $R_1$ is a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted alkyl group having from 1 to 28 (preferably from 1 to 8) carbon atoms (such as methyl, ethyl, propyl, butyl, 2-ethylhexyl, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted alkenyl group having from 1 to 28 (preferably from 1 to 8) carbon atoms (such as an allyl group, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted cycloalkyl group having from 3 to 28 (preferably from 3 to 12) carbon atoms (e.g., a cyclohexyl group, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, a methylenedioxy group, and a hydroxyl group) or unsubstituted aryl group having from 6 to 33 (preferably from 6 to 12) carbon atoms (such as phenyl, 4-methylenedioxyphenyl, 3-sulfamoylphenyl, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted heterocyclic ring having from 1 to 28 (preferably from 1 to 14) carbon atoms and one or more hetero atoms, such as N, O, and S (e.g., 4-pyridyl); an alkyl, cycloalkyl, alkenyl, alkoxyalkyl, aryl, or phenoxy group connecting to a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, and a hydroxyl group) or unsubstituted aromatic ring (such as phenyl, naphthyl); or an alkyl, cycloalkyl, alkenyl, alkoxyalkyl, aryl, or phenoxy group connecting to a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, and a hydroxyl group) or unsubstituted heterocyclic ring (containing one or more heteroatoms such as N, O, and/or S) having 1 to 25 (preferably 2 to 10) carbon atoms;

$R_2$ is a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted amine group having from 0 to 25 (preferably from 0 to 8) carbon atoms (such as amino, methylamino, ethylamino, 2-ethylhexylamino, etc.); is a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, and a hydroxyl group) or unsubstituted alkyl group having from 1 to 28 (preferably from 1 to 8) carbon atoms (such as methyl, ethyl, propyl, butyl, 2-ethylhexyl, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted alkenyl group having from 1 to 28 (preferably from 1 to 8) carbon atoms (such as an allyl group, etc.), a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted cycloalkyl group from 3 to 28 (preferably from 3 to 12) carbon atoms (e.g, a cyclohexyl group, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, and a hydroxyl group) or unsubstituted acyloxy group having from 2 to 25 (preferably from 2 to 8) carbon atoms (such as acetoxy, benzoyloxy, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted alkoxy group having from 1 to 28 (preferably from 1 to 8) carbon atoms (such as methoxy, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, a methylenedioxy group, and a hydroxyl group) or unsubstituted aryl group having from 6 to 33 (preferably from 6 to 12) carbon atoms (such as phenyl, 4-methylenedioxyphenyl, 3-sulfamoylphenyl, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted heterocyclic ring having from 1 to 28 (preferably from 1 to 14) carbon atoms and one or more hetero atoms, such as N, O, and S; an alkyl, cycloalkyl, alkenyl, alkoxyalkyl, aryl, or phenoxy group connecting to a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, and a hydroxyl group) or unsubstituted aromatic ring (such as phenyl, naphthyl); or an alkyl, cycloalkyl, alkenyl, alkoxyalkyl, aryl, or phenoxy group connecting to a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted heterocyclic ring (containing one or more hetero atoms such as N, O, and/or S) having 1 to 25 (preferably 2 to 10) carbon atoms (e.g., 2-(1',5'-dimethyl-1',2',4'-triazolium-3'-thiolate-4'-)ethyl);

$R_3$ is a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted amine group having from 0 to 25 (preferably from 0 to 8) carbon atoms (such as amino, methylamino, ethylamino, 2-ethylhexylamino, etc.); is a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, and a hydroxyl group) or unsubstituted alkyl group having from 1 to 28 (preferably from 1 to 8) carbon atoms (such as methyl, ethyl, propyl, butyl, 2-ethylhexyl, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted alkenyl group having from 1 to 28 (preferably from 1 to 8) carbon atoms (such as an allyl group, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted cycloalkyl group having from 3 to 28 (preferably from 3 to 12) carbon atoms (e.g., a cyclohexyl group, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, and a hydroxyl group) or unsubstituted acyloxy group having from 2 to 25 (preferably from 2 to 8) carbon atoms (such as acetoxy, benzoyloxy, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted alkoxy group having from 1 to 28 (preferably from 1 to 8) carbon atoms (such as methoxy, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, a methylenedioxy group, and a hydroxyl group) or unsubstituted aryl group having from 6 to 33 (preferably from 6 to 12) carbon atoms (such as phenyl, 4-methylene dioxyphenyl, 3-sulfamoylphenyl, etc.); a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted heterocyclic ring having from 1 to 28 (preferably from 1 to 14) carbon atoms and one or more hetero atoms, such as N, O, and S (e.g., 2-pyridyl); an alkyl, cycloalkyl, alkenyl, alkoxyalkyl, aryl, or phenoxy group connecting to a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxy group, an amino group, and a hydroxyl group) or unsubstituted aromatic ring (such as phenyl, naphthyl); or an alkyl, cycloalkyl, alkoxyalkyl, aryl, or phenoxy group connecting to a substituted (with a group such as an alkoxy group having from 1 to 6 carbon atoms, a thioalkoxy group having from 1 to 6 carbon atoms, an alkoxycarbonyl group having from 2 to 8 carbon atoms, a cyano group, a carboxyl group, an amino group, and a hydroxyl group) or unsubstituted heterocyclic ring containing one or more hetero atoms such as N, O, and/or S) having 1 to 25 (preferably 2 to 10) carbon atoms;

said $R_1$, $R_2$, and $R_3$ may further combine with each other to form a 5-, 6-, or 7-membered ring.

The method of the invention may be utilized with any desired negative-type black and white photographic film or print paper that is developable with dihydroxybenzenes, 3-pyrazolidones, and aminophenols. Further, the invention can be used in combination with developers that contain preservatives, alkali agents, pH buffers, antifoggants, and further as necessary dissolution aids, toning aids, surface active agents, antifoaming agents, water softeners, and hardening agents. It is particularly suitable for use with black-and-white films where there is a need for accelerated development, particularly for black-and-white films utilized with x-rays where rapid development is particularly desired by the consumer. It is also advantitiously used with black and white reflection print materials such as black and white negative-type print paper.

While the invention is applied either as a prebath prior to exposure of the photographic element to a developer, or in the developing bath itself, the remaining steps of the photographic processing may use any conventional technique. It is particularly preferred to exclude iron(III) ion complex materials from the developer baths and developer prebaths of the present invention so that latent image cannot be inadvertently bleached before or during development. It is preferred to exclude any known silver bleaching agents from the baths of the present invention in order to guard against the bleaching of latent image.

Bergthaller et al., in U.S. Pat. No. 4,939,075 incorporated herein by reference for all that it discloses, describe bleaching and bleaching/fixing baths for use with color materials, wherein said baths contain an iron(III) ion complex salt as bleach and in addition contain a 5- to 7-membered heterocyclic compound containing at least one nitrogen atom and at least one other hetero atom from the group consisting of oxygen, sulfur, and nitrogen, wherein said heterocyclic compound is mesoionic, in that said compound cannot be represented in a tautomerically neutral thione form.

Invention compounds having aqueous solubility in excess of $10^{-5}$ moles/L are preferred so that the developer baths and prebaths of the present invention may be prepared rapidly. Suitable examples of such compounds include compounds B1–B13 disclosed by Bergthaller et al., in U.S. Pat. No. 4,939,075, and incorporated herein above by reference. Other suitable examples of such compounds include compounds 1–10 on pages 8–10 in copending and commonly assigned U.S. application Ser. No. 07/763,028 of Texter et al., filed Sep. 20, 1991. A particularly preferred accelerator compound for utilization in the invention is Compound 1.

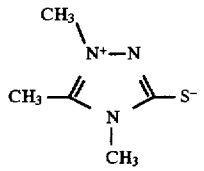

(1)

This compound is preferred because it provides effective acceleration of the typical photographic element without producing undesirable side effects. The efficacy of these compounds as development accelerators has been hypothesized to be related to the propensity of these compounds to bind to silver halide surfaces and to form soluble silver halide complexes, as described by Texter in *Hydroquinone Development Acceleration by Triazolium Thiolates*, published in the *Journal of Photographic Science*, volume 40, Issue Number 3, 1992, pages 83–88, and in *Aqueous Silver-Triazolium Thiolate Complexes*, published in *Analytica Chimica Acta*, volume 248, 1991, pages 603–614, the disclosures of which are incorporated herein in their entirety.

Kojima et al., in U.S. Pat. No. 5,037,726 incorporated herein by reference for all that it discloses, describe the use of triazolium thiolates as nucleation accelerators in the processing of direct-positive photographic elements. Kojima et al. also describe the preferred use of nucleating agents to chemically fog the direct positive emulsions described therein, and these nucleating agents are described in column 16, line 66 through column 19, line 40 of Kojima et al. Kojima et al. preferably incorporate said nucleating agents into the direct-positive photographic element; said nucleating agents can also be placed in developer baths and prebaths thereof. Said nucleating agents, as described by Kojima et al. and incorporated herein by reference above, are pointedly excluded from the baths of the bath and method of the present invention, because their inclusion would yield unwanted fogging of the negative-type black-and-white photographic materials of the present invention. The use of developer baths or prebaths containing said nucleating agents in combination with triazolium thiolates would render the negative-type black-and-white photographic materials of the claims of the present invention useless.

The following examples are illustrative of the invention and are not to be intended as exhaustive of all possibilities. Parts and percentages are by weight unless otherwise indicated.

In an embodiment of the present invention, said accelerator compound is present in an aqueous solution at about $10^{-8}$ to about $10^{-1}$ moles/L. In another embodiment of the present invention, said accelerator compound is present in an amount of $10^{-5}$ to about $10^{-3}$ moles/L of aqueous solution.

In an embodiment of the present invention, the contacting time for aqueous accelerator solution to contact said photographic element is between about 0.01 second to 10 minutes. In another embodiment of the present invention, said time for aqueous accelerator solution to contact said photographic element is between about 1 and 60 seconds.

SYNTHESIS

The 4,5-substituted-1-methyl-1,2,4-triazolium-3-thiolates were synthesized by a modification of the method of Potts et al. (*J. Org. Chem.*, 32 (1967) p. 2245).

SYNTHESIS (COMPOUND 1)

Acetic anhydride (10.2 g, 0.1 mol) was slowly added to a stirred distilled water (11 g) solution of methyl hydrazine (4.6 g, 0.1 mol) at ice-bath temperature. The resulting solution was stirred at room temperature for one hour and the water was removed under reduced pressure. The residual oily acethydrazide was suspended in ethyl ether and to this stirred mixture at room temperature was slowly added an ether (25 mL) solution of methyl isothiocyanate (7.3 g, 0.1 mol). The resulting stirred solution was kept at room temperature for 30 minutes and then the solvent was removed under reduced pressure. The residual colorless solid was triturated with ethyl ether to give 4.9 g (30 percent) of the thiosemicarbazide (a white powder); m.p., 180° to 181° C. (lit. m.p. 175° to 177° C.). The thiosemicarbazide (5.0 g, 0.03 mol) was refluxed in a methanol (25 mL) solution for 21 hours. During this reflux period, the thiosemicarbazide completely dissolved in the refluxing methanol and the triazolium thiolate, a colorless solid, then separated (m.p., 258° to 259° C.; lit. m.p. 256° to 257° C.

EXAMPLES 1–6

A control coating was prepared by coating a polydisperse octahedral $Ag_2S$-sensitized silver bromoiodide emulsion (6 mole % I) at 4.89 g Ag/m$^2$ and 11.1 g gel/m$^2$. Examples 1 to 6 were prepared by coating Compound 1 at 0.3 and 3.0 mmol/mol Ag respectively, like the control coating described above. The coatings were exposed (1 sec, 500 W, 2850° K) to tungsten light, processed for 2¾ min. in Kodak Super RT Developer, fixed, washed, and dried. The coatings also were exposed (1 sec, 500 W, 2850° K) to tungsten light, processed for 4 min. in Kodak D-19 Developer, fixed, washed, and dried. Sets of coatings were processed and evaluated while fresh. Other sets were processed and evaluated after 1-week or 2-week incubations at 120° F./50% relative humidity. The fog ($D_{min}$) measured for these examples is tabulated in Table I below for Kodak Super RT development and in Table II below for Kodak D-19 development. The data show that Compound 1 (Compound 25 in U.S. Pat. No. 4,675,276) causes significant fresh fog and significant incubation fog when used according to the prescriptions of the invention in U.S. Pat. No. 4,675,276.

TABLE I (Kodak Super RT Development)

| Example | Compound | Level (mmol/mol Ag) | Fresh Dmin |
|---|---|---|---|
| 1 (control) | None | None | 0.04 |
| 2 | 1 | 0.3 | 0.18 |
| 3 | 1 | 3.0 | 0.69 |

TABLE II (Kodak D-19 Development)

| Example | Compound | Level (mmol/mol Ag) | Dmin Fresh | 1 Week | 2 Weeks |
|---|---|---|---|---|---|
| 4 (Control) | None | None | 0.30 | 0.63 | 1.47 |
| 5 | 1 | 0.3 | 0.27 | 1.07 | 1.95 |
| 6 | 1 | 3.0 | 1.47 | 1.59 | 1.87 |

EXAMPLES 7–14

A set of coatings similar to the coating of Example 1 was prepared, except that the emulsion was coated at a level of 8.3 g Ag/m$^2$. These coatings were exposed as described in Examples 1–6, and processed for various times at 23° C. in a developer solution having the following composition: 14.5 g hydroquinone/L, 3 g $Na_2SO_3$/L, 3 g KBr/L, 2 g Kodak Antical/L, 6 g boric acid/L, 65 g sodium formaldehyde bisulfite (hemihydrate)/L, and 83 g $Na_2CO_3$/L. The controls were exposed and developed without soaking in a triazolium thiolate prebath. The example coatings illustrating the present invention were soaked in a $2.3\times10^{-5}$ mole/L solution in a prebath of Compound 1 for 5 sec. before processing in the developer. After development, the coatings were fixed and dried as described for the Examples 1–6. The sensitometric results are shown in Table III. The results illustrated in Table III show that development acceleration yields increased Dmax in a given development time. Greater Dmax is proportional to increased development acceleration. These results also show that development times can be found in which significantly increased Dmax are obtained without significantly increased Dmin.

TABLE III

| Minutes Development | Example | Dmin | Dmax |
|---|---|---|---|
| 1 | 7 (Control) | 0.03 | 0.05 |
| 1 | 8 | 0.03 | 0.75 |
| 2 | 9 (Control) | 0.03 | 0.15 |
| 2 | 10 | 0.08 | 1.80 |
| 3 | 11 (Control) | 0.04 | 1.12 |
| 3 | 12 | 0.12 | 2.52 |
| 4 | 13 (Control) | 0.05 | 2.82 |
| 4 | 14 | 0.22 | 3.50 |

The invention has been described in detail with particular reference to preferred embodiments thereof, but it will be understood that variations and modifications can be effected within the spirit and scope of the invention.

What is claimed is:

1. A method of accelerating image formation during black and white development of a negative type silver halide photographic element comprising the steps of:

exposing said negative type silver halide photographic element to actinic radiation; and contacting said negative-type silver halide photographic element during processing with a developer prebath or a developer bath comprising an accelerator compound of the formula:

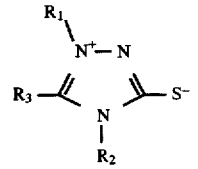

wherein $R_1$ is a substituted or unsubstituted alkyl group having from 1 to 28 carbon atoms, a substituted or unsubstituted alkenyl group having from 1 to 28 carbon atoms, a substituted or unsubstituted cycloalkyl group having from 3 to 28 carbon atoms, a substituted or unsubstituted aryl group having from 6 to 33 carbon atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkenyl, alkoxyalkyl, aryl, or phenoxy group connecting to a substituted or unsubstituted heterocyclic ring containing two or more heteroatoms having 1 to 25 carbon atoms;

$R_2$ is a substituted or unsubstituted amine group having from 0 to 25 carbon atoms, a substituted or unsubstituted alkyl group having from 1 to 28 carbon atoms, a substituted or unsubstituted alkenyl group having from 1 to 28 carbon atoms, a substituted or unsubstituted cycloalkyl group from 3 to 28 carbon atoms, a substituted or unsubstituted acyloxy group having from 2 to 25 carbon atoms, a substituted or unsubstituted alkoxy group having from 1 to 28 carbon atoms, a substituted or unsubstituted aryl group having from 6 to 33 carbon atoms, a substituted or unsubstituted heterocyclic ring having from 1 to 28 carbon atoms and one or more hetero atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkenyl, alkoxyalkyl, aryl, or phenoxy group connecting to a substituted or unsubstituted heterocyclic ring containing two or more hetero atoms having 1 to 25 carbon atoms;

$R_3$ is a substituted or unsubstituted amine group having from 0 to 25 carbon atoms, a substituted or unsubstituted alkyl group having from 1 to 28 carbon atoms, a substituted or unsubstituted alkenyl group having from 1 to 28 carbon atoms, a substituted or unsubstituted cycloalkyl group having from 3 to 28 carbon atoms, a substituted or unsubstituted acyloxy group having from 2 to 25 carbon atoms, a substituted or unsubstituted alkoxy group having from 1 to 28 carbon atoms, a substituted or unsubstituted aryl group having from 6 to 33 carbon atoms, a substituted or unsubstituted heterocyclic ring having from 1 to 28 carbon atoms and one or more hetero atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkoxyalkyl, aryl, or phenoxy group connecting to a substituted or unsubstituted heterocyclic ring containing two or more hetero atoms;

said $R_1$, $R_2$, and $R_3$ may further combine with each other to form a 5-, 6-, or 7-membered ring; and wherein said developer prebath and developer bath do not contain any iron(III) ion complex salt having bleaching activity or any nucleating agent capable of chemically fogging a negative-type silver halide emulsion.

2. The method of claim 1, wherein said contacting is in a developer bath.

3. The method of claim 1, wherein said contacting is in a developer prebath prior to developing.

4. The method of claim 1, wherein said accelerator compound comprises:

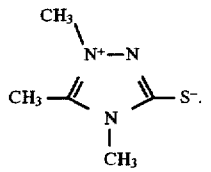

5. The method of claim 1, wherein said accelerator compound is present in an aqueous solution at about $10^{-8}$ to about $10^{-3}$ moles/L.

6. The method of claim 1, wherein said accelerator compound is present in an amount of $10^{-5}$ to about $10^{-3}$ moles/L of aqueous solution.

7. The method of claim 1, wherein the accelerator contacting time for aqueous accelerator solution to contact said photographic element is between 0.01 second and 10 minutes.

8. The method of claim 7, wherein said time is between 1 and 60 seconds.

9. The method of claim 1, wherein said development comprises developing agent selected from the group comprising dihydroxybenzenes, 3-pyrazolidones, and aminophenols.

10. The method of claim 1, wherein said element is an x-ray film.

11. The method of claim 1, wherein said element is a paper print material.

12. A method of accelerating image formation during black and white development of a negative type silver halide photographic element comprising the steps of:

exposing said negative type silver halide photographic element to actinic radiation; and contacting said negative-type silver halide photographic element during developing with a developer bath comprising an accelerator compound of the formula:

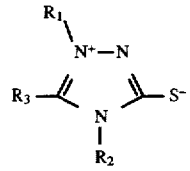

wherein $R_1$ is a substituted or unsubstituted alkyl group having from 1 to 28 carbon atoms, a substituted or unsubstituted alkenyl group having from 1 to 28 carbon atoms, a substituted or unsubstituted cycloalkyl group having from 3 to 28 carbon atoms, a substituted or unsubstituted aryl group having from 6 to 33 carbon atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkenyl, alkoxyalkyl, aryl, or phenoxy group connecting to a substituted or unsubstituted heterocyclic ring containing two or more heteroatoms having 1 to 25 carbon atoms;

$R_2$ is a substituted or unsubstituted amine group having from 0 to 25 carbon atoms, a substituted or unsubstituted alkyl group having from 1 to 28 carbon atoms, a substituted or unsubstituted alkenyl group having from 1 to 28 carbon atoms, a substituted or unsubstituted cycloalkyl group from 3 to 28 carbon atoms, a substituted or unsubstituted acyloxy group having from 2 to 25 carbon atoms, a substituted or unsubstituted alkoxy group having from 1 to 28 carbon atoms, a substituted or unsubstituted aryl group having from 6 to 33 carbon atoms, a substituted or unsubstituted heterocyclic ring having from 1 to 28 carbon atoms and one or more hetero atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkenyl, alkoxyalkyl, aryl, or phenoxy group connecting to a substituted or unsubstituted heterocyclic ring containing two or more hetero atoms having 1 to 25 carbon atoms;

$R_3$ is a substituted or unsubstituted amine group having from 0 to 25 carbon atoms, a substituted or unsubstituted alkyl group having from 1 to 28 carbon atoms, a substituted or unsubstituted alkenyl group having from 1 to 28 carbon atoms, a substituted or unsubstituted cycloalkyl group having from 3 to 28 carbon atoms, a substituted or unsubstituted acyloxy group having from 2 to 25 carbon atoms, a substituted or unsubstituted alkoxy group having from 1 to 28 carbon atoms, a substituted or unsubstituted aryl group having from 6 to 33 carbon atoms, a substituted or unsubstituted heterocyclic ring having from 1 to 28 carbon atoms and one or more hetero atoms, an alkyl, cycloalkyl, alkenyl, alkoxyalkyl, aryl, or phenoxy group, connecting to a substituted or unsubstituted aryl group, having 6 to 33 carbon atoms, or an alkyl, cycloalkyl, alkoxyalkyl, aryl, or phenoxy group connecting to a substituted or unsubstituted heterocyclic ring containing two or more hetero atoms;

said $R_1$, $R_2$, and $R_3$ may further combine with each other to form a 5-, 6-, or 7-membered ring; and wherein said developer bath does not contain any iron(III) ion complex salt having bleaching activity or any nucleating agent capable of chemically fogging a negative-type silver halide emulsion; and said accelerator compound is present in said developer bath at about $10^{-8}$ to about $10^{-3}$ moles/L.

13. The method of claim 12, wherein said accelerator compound comprises:

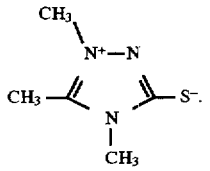

14. The method of claim 12, wherein said accelerator compound is present in an amount of $10^{-5}$ to about $10^{-3}$ moles/L of aqueous solution.

15. The method of claim 12, wherein the accelerator contacting time for aqueous accelerator solution to contact said photographic element is between 0.01 second and 10 minutes.

16. The method of claim 15, wherein said time is between 1 and 60 seconds.

17. The method of claim 12, wherein said development comprises developing agent selected from the group comprising dihydroxybenzenes, 3-pyrazolidones, and aminophenols.

18. The method of claim 12, wherein said element is an x-ray film.

19. The method of claim 12, wherein said element is a paper print material.

* * * * *